US006145358A

United States Patent [19]

Wu

[11] Patent Number: 6,145,358

[45] Date of Patent: Nov. 14, 2000

[54] AUXILIARY LOCK WITH A CONTROL PLATE FOR PREVENTING UNLATCHING FROM OUTSIDE

[75] Inventor: Wen-Bin Wu, Kaohsiung Hsien, Taiwan

[73] Assignee: Taiwan Fu Hsing Industrial Co., Ltd., Kaohsiung Hsien, Taiwan

[21] Appl. No.: 09/291,287

[22] Filed: Apr. 14, 1999

[51] Int. Cl.[7] ..... E05B 55/04

[52] U.S. Cl. ..... 70/467; 70/416; 70/381

[58] Field of Search ..... 70/467, 468, 224, 70/190, 379 R–381, 416; 292/150

[56] References Cited

U.S. PATENT DOCUMENTS

| | | | |
|---|---|---|---|
| 1,956,388 | 4/1934 | Kalina | 70/416 |
| 3,815,390 | 6/1974 | Stoia | 70/381 X |
| 3,919,867 | 11/1975 | Lipschutz et al. | 70/416 X |
| 5,010,749 | 4/1991 | Lin | 70/190 |
| 5,150,592 | 9/1992 | Lin | 70/190 |
| 5,199,285 | 4/1993 | Lin | 70/190 X |
| 5,901,590 | 5/1999 | Lai | 70/416 |
| 5,950,467 | 9/1999 | Dong | 70/467 |

OTHER PUBLICATIONS

Taiwanese Patent Document No. 015027.

Taiwanese Patent Document No. 0000576.

English Document Corresponding to Taiwanese Patent Document No. 0000576.

*Primary Examiner*—Suzanne Dino Barrett

*Attorney, Agent, or Firm*—Stevens, Davis, Miller & Mosher, L.L.P.

[57] ABSTRACT

An auxiliary lock includes an exterior lock assembly having a knob and an actuating plate that is connected to the knob to rotate therewith. A casing is mounted inside a door for rotatably supporting a knob that is also connected to the actuating plate to rotate therewith. A control plate is mounted in the casing and includes a first end extended beyond the casing for manual operation. A second end of the control plate includes a notch releasably engaged with one of a number of teeth of an engaging wheel mounted in the casing. The control plate is movable vertically and retained in place by a positioning element. The engaging wheel is connected to the actuating plate to rotate therewith.

6 Claims, 5 Drawing Sheets

AUXILIARY LOCK WITH A CONTROL PLATE FOR PREVENTING UNLATCHING FROM OUTSIDE

BACKGROUND OF THE INVENTION

1. Field of the Invention

The present invention relates to an auxiliary lock with a control plate for preventing unlatching from outside.

2. Description of the Related Art

Taiwan Utility Model Publication No. 182885 issued on Apr. 21, 1992 discloses an auxiliary lock having a cavity for receiving a spring and a steel ball. The steel ball may bear against an inner toothed face of a toothed ring which is mounted in a knob to rotate therewith. Nevertheless, unintentional rotational movement relative to the knob may occur and thus result in undesired locking when in use.

Taiwan Utility Model Publication No. 346987 issued on Dec. 1, 1998 discloses an auxiliary lock having a latch plate mounted to a mounting plate. An engaging wheel is provided in a notch in the latch plate to prevent rotational movement of the engaging wheel. The latch plate is supported by elastic members so as to be moved upward or downward to a proper level. Nevertheless, the elastic members may have fatigue or be worn and thus cannot retain the latch plate in place. As a result, the control plate may fall and thus cause problem to operation.

The present invention is intended to provide an improved auxiliary lock that mitigates and/or obviates the above problems.

SUMMARY OF THE INVENTION

It is a primary object of the present invention to provide an auxiliary lock that includes a control plate in an inner side of a door to control rotational movement of the outer knob outside the door, thereby preventing unintentional locking.

It is a further object of the present invention to provide an auxiliary lock that includes a positioning member for reliably retaining the control plate in a pre-determined position.

It is another object of the present invention to provide an auxiliary lock that can be locked or unlocked from the inside by means of operating a thumbturn inside the door that actuates a deadbolt of the auxiliary lock.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
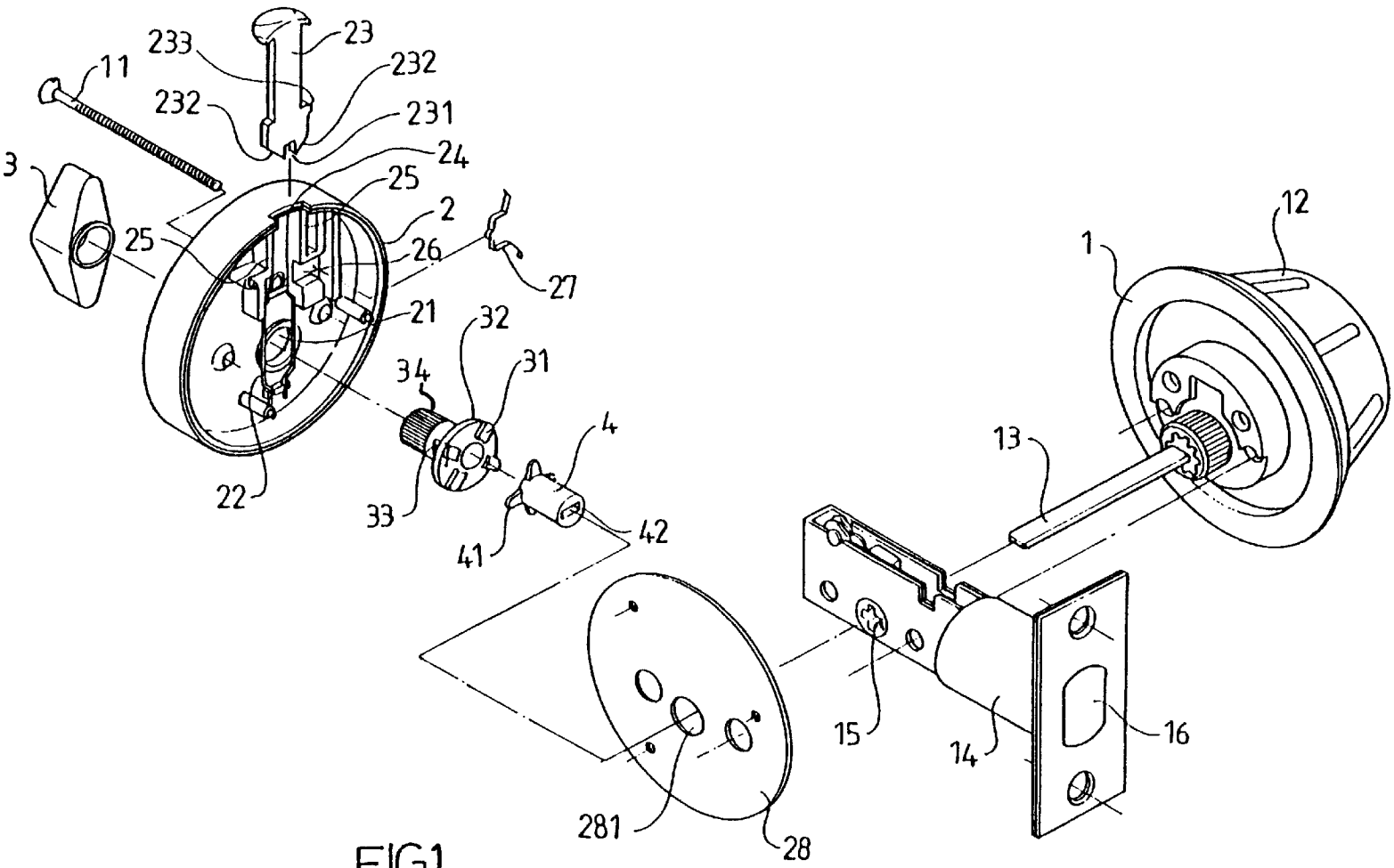
FIG. 1 is an exploded perspective view of an auxiliary lock in accordance with the present invention.
Figure 2:
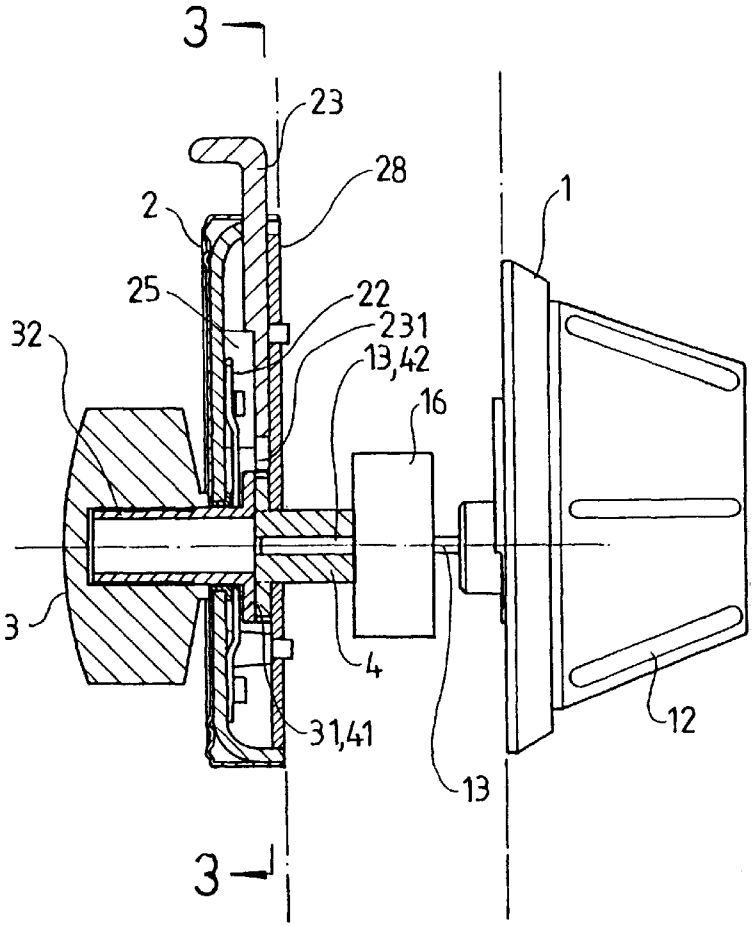
FIG. 2 is a side view, partly sectioned, of the auxiliary lock in accordance with the present invention.

Referring to FIGS. 1 and 2, an auxiliary lock in accordance with the present invention generally includes an exterior lock assembly 1, a casing 2, a thumbturn 3, and an engaging wheel 4. The exterior lock assembly 1 is mounted to an outer side of a door (not labeled) by fasteners 11 (e.g., bolts). Rotation of a knob 12 causes rotation of an actuating plate 13 to extend or retract a deadbolt 16 of a latch assembly 14 by means of turning a wheel 15 in the latch assembly 14.

The casing 2 is extended through by the fasteners 11 and mounted to an inner side of the door. The casing 2 includes an axle hole 21 for rotatably supporting a shaft 34. The thumbturn 3 securely engages with the shaft 34 to rotate therewith. A wheel 32 is attached to an end of the shaft 34 and includes a number of teeth 31 on a face thereof. The shaft 34 includes a recessed non-circular section 33 on each of two lateral sides thereof so as to be retained by two elastic members 22 which are mounted to both sides of the axle hole 21. Thus, the thumbturn 3 is held by the elastic members 22.

Figure 3:
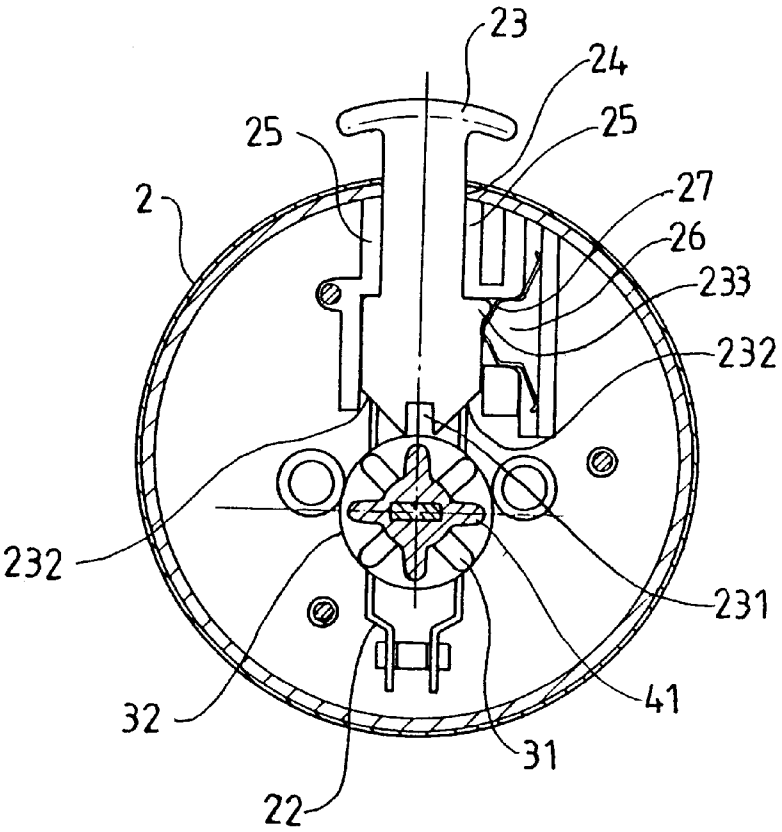
FIG. 3 is a sectional view taken along line 3—3 in FIG. 2.

The casing 2 further includes a control plate 23 that moves vertically along a track (e.g., a slot 24 or vertical walls 25) of the casing 2. The control plate 23 has an upper end extended beyond the casing 2 so as to be manually pressed downward or lifted upward. The control plate 23 includes a notch 231 in a lower end thereof and two inclined surfaces 232 on both sides of the notch 231. In addition, a protrusion 233 is formed in a mediate portion of the control plate 23. The protrusion 233 (FIG. 3) is slidably received in a groove 26 in one vertical wall 25. A positioning element 27 (e.g., a spring plate) includes an end that abuts against an upper side or a lower side of the protrusion 233 and thus retains the protrusion 233 in place. A cover plate 28 is mounted to the casing 2 and thus encloses all of the elements in the casing 2.

The engaging wheel 4 is rotatably mounted to a hole 281 of the mounting plate 28. The engaging wheel 4 includes a number of teeth 41 in an end thereof for engaging with the teeth 31 of the wheel 32. The other end of the engaging wheel 4 has a non-circular hole 42 for engaging with the actuating plate 13 to rotate therewith.

Referring to FIG. 2, the exterior lock assembly 1 is mounted to the outer side of the door and the casing 2. The actuating plate 13 extends through the wheel 15 as well as the hole 42 of the engaging wheel 4 so as to engage with the thumbturn 3 via the engagement of the teeth 31 and 41. Since the non-circular sections 33 of the shaft 34 are clamped by the elastic members 22, when the control plate 23 moves upward to an unlatching position where it is retained in place by the positioning element 27 (FIG. 3), the notch 231 of the control plate 23 disengages from the tooth 41 of the engaging wheel 4. In this case, the deadbolt 16 of the latch assembly 14 can be extended or retracted by turning either the thumbturn 3 or the knob 12.

Figure 4:
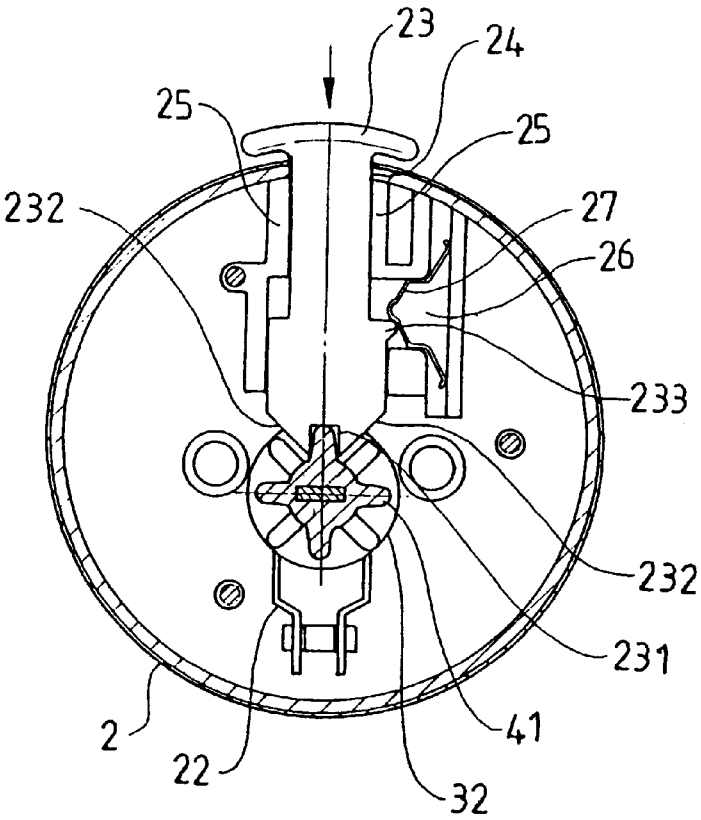
FIG. 4 is a sectional view similar to FIG. 3, wherein a control plate is moved downward.

Referring to FIG. 4, when the control plate 23 is pressed downward to a latching position retained by the positioning element 27, the notch 231 of the control plate 23 engages with one tooth 41 of the engaging wheel 4. As a result, rotational movement of the knob 12 is prevented, thereby preventing extending or retracting of the deadbolt 16. Thus, unintentional latching as a result of rotation of the knob 12 is prevented.

Figure 5:
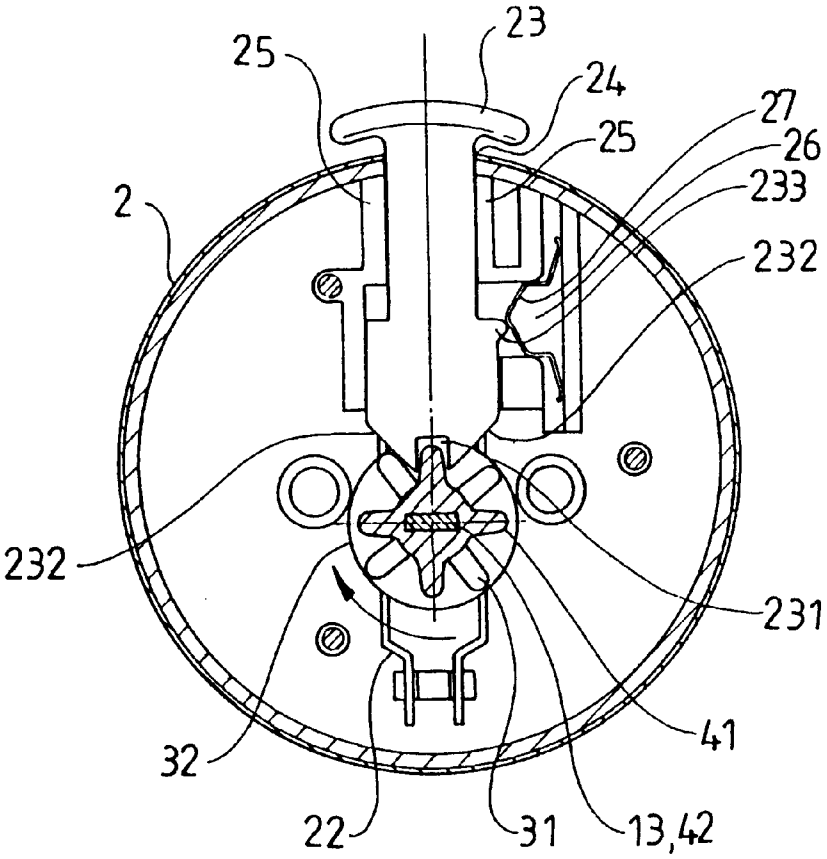
FIG. 5 is a sectional view similar to FIG. 4, illustrating rotational movement of a wheel.

Referring to FIG. 5, when the deadbolt 16 is in its extended position (or the deadbolt 16 is in its retracted position while the control plate 23 is lowered to engage the notch 231 with the tooth 41 of the engaging wheel 4), picking from outside to rotate the actuating plate 13 is prevented since the engaging wheel 4 cannot be rotated.

In addition, when the control plate 23 is in its lower position wherein the notch 231 engages with the tooth 41 of the engaging wheel 4, unlatching can be achieved by means of directly pulling the control plate 23 upward to disengage the notch 231 from the tooth 41. Alternatively, the thumbturn 3 may be directly turned to extend or retract the deadbolt 16, as the one of the teeth 31 of the wheel 32 that rotates in response to rotation of the thumbturn 3 acts against one of the inclined surface 232 of the control plate 23. As a result, the control plate 23 is moved upward, the engaging wheel 4 is also rotated since the teeth 31 engage with teeth 41. Thus, the actuating plate 13 is rotated to extend or retract the deadbolt 16. Accordingly, latching or unlatching can be achieved by means of directly turning the thumbturn 3 without previously lifting of the control plate 23.

Figure 6:
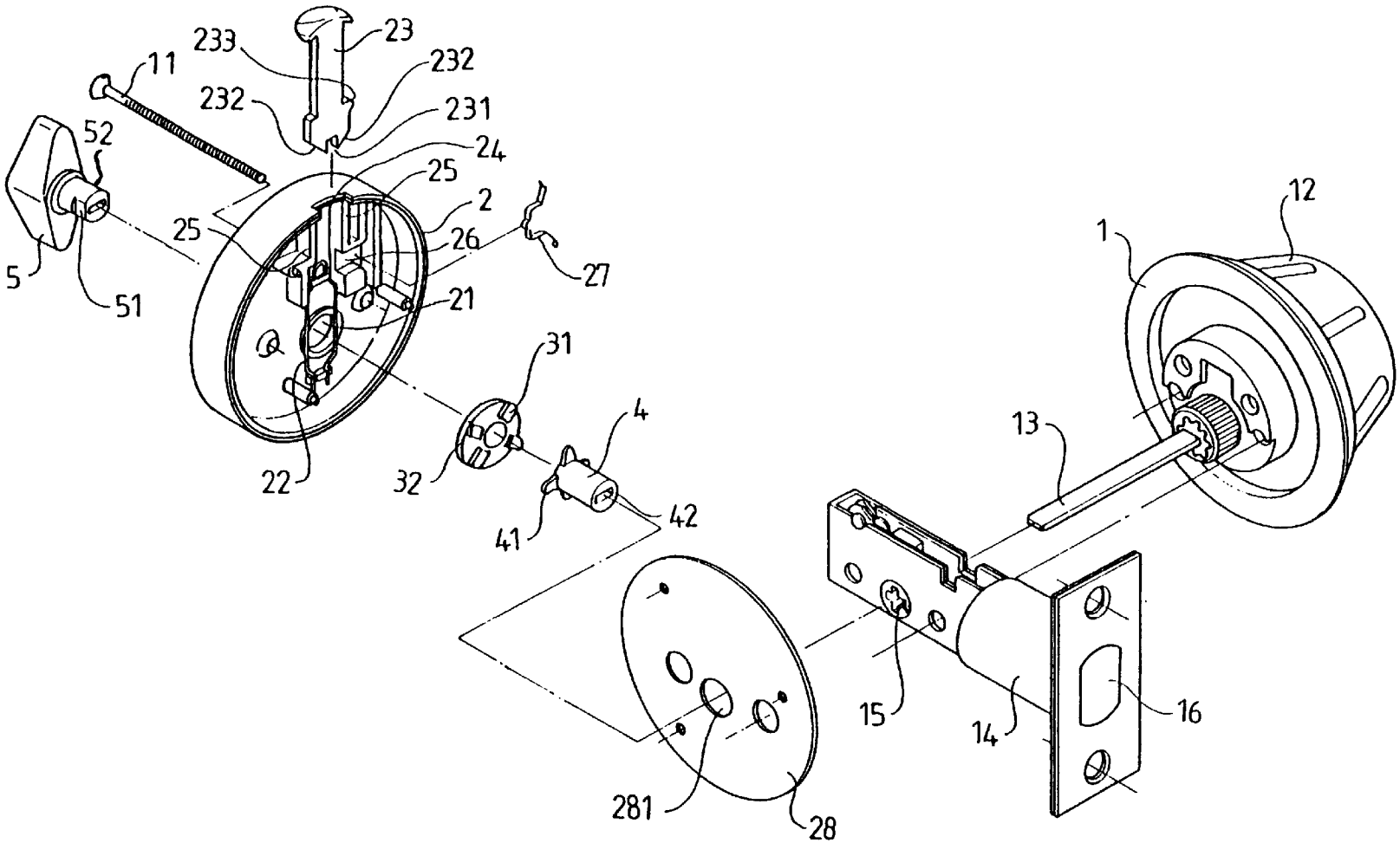
FIG. 6 is an exploded perspective view illustrating a modified embodiment of the auxiliary lock in accordance with the present invention.

FIG. 6 illustrates a modified embodiment of the thumbturn wherein the thumbturn (now designated by 5) includes an integral shaft 52 that corresponds to the shaft 34 in FIG. 1, and the integral shaft 52 includes two recessed non-circular sections 51 that correspond to the recessed non-circular sections 33. The integral shaft 52 is securely engaged with a wheel 32 with a number of teeth 31 on a face thereof. Operation of the thumbturn in FIG. 6 is identical to that disclosed in the first embodiment and therefore not further described to avoid redundancy.

According to the above description, it is appreciated that the control plate 23 of the present invention mounted to the inner side of the door may prevent locking or unlocking from outside to thereby prevent from unintentional locking as a result of rotation of the knob 12 and to prevent picking. In addition, the control plate 23 is reliably positioned by the positioning element 27 to prevent falling of the control plate 23 as a result of fatigue and to prevent incorrect control. Furthermore, the arrangement of the inclined surfaces 232 and the teeth 41 on the engaging wheel 4 allows direct locking and unlocking from inside by means of turning the thumbturn 3, 5.

Although the invention has been explained in relation to its preferred embodiment, it is to be understood that many other possible modifications and variations can be made without departing from the spirit and scope of the invention as hereinafter claimed.

What is claimed is:

1. An auxiliary lock comprising:

an exterior lock assembly including a knob and an actuating plate connected to the knob to rotate therewith;

a casing including an axle hole and a track;

a thumbturn including a portion rotatably supported in the axle hole of the casing, a control plate slidably received in the track of the casing and including a first end extended beyond the casing, a second end with a notch, and a protrusion which is disposed within the casing and which is arranged at a lateral edge between said first end and said second end, the protrusion having an upper side and a lower side;

a positioning element mounted in the casing for retaining the control plate in a predetermined position, said positioning element including an end portion for abutting against either of the upper side and the lower side of the protrusion, so that the control plate is retained in a latched position when said end portion is abutted against the upper side of the protrusion, and the control plate is retained in an unlatched position when said end portion is abutted against the lower side of the protrusion; and an engaging wheel mounted in the casing and including a plurality of teeth for selectively and releasably engaging with the notch of the control plate in said latched position, wherein a first end of the engaging wheel is connected to the actuating plate to rotate therewith, and a second end of the engaging wheel is connected to the thumbturn to rotate therewith.

2. The auxiliary lock as claimed in claim 1, further comprising a cover plate for enclosing an open side of the casing, the cover plate including a hole through which the engaging wheel is rotatably extended.

3. The auxiliary lock as claimed in claim 1, further comprising two elastic members mounted to both sides of the axle hole, the thumbturn including a non-circular section on each of two lateral sides thereof so as to be held by the elastic members.

4. An auxiliary lock comprising:

an exterior lock assembly including a knob and an actuating plate connected to the knob to rotate therewith;

a casing including an axle hole and a track;

a thumbturn including a portion rotatably supported in the axle hole of the casing;

a first wheel connected to the thumbturn to rotate therewith;

a control plate slidably received in the track of the casing and including a first end extended beyond the casing a second end with a notch and two inclined surfaces on both sides of the notch and a protrusion which is disposed within the casing and which is arranged at a lateral edge between said first end and said second end, the protrusion having an upper side and a lower side;

a positioning element mounted in the casing for retaining the control plate in a predetermined position, said positioning element including an end portion for abutting against either of the upper side and the lower side of the protrusion, so that the control plate is retained in a latched position when said end portion is abutted against the upper side of the protrusion, and the control plate is retained in an unlatched position when said end portion is abutted against the lower side of the protrusion; and an engaging wheel mounted in the casing and including a plurality of teeth for selectively and releasably engaging with the notch of the control plate in the latched position, wherein a first end of the engaging wheel is connected to the actuating plate to rotate therewith, and a second end of the engaging wheel is connected to the thumbturn to rotate therewith, the inclined surfaces of the control plate being operably connected with said first wheel connected to the thumbturn such that rotation of the thumbturn causes movement of the control plate away from the engaging wheel and toward the unlatched position.

5. The auxiliary lock as claimed in claim 4, further comprising a cover plate for enclosing an open side of the casing, the cover plate including a hole through which the engaging wheel is rotatably extended.

6. The auxiliary lock as claimed in claim 4, further comprising two elastic members mounted to both sides of the axle hole, the wheel on the thumbturn including a non-circular section on each of two lateral sides thereof so as to be held by the elastic members.

* * * * *